US005768746A

United States Patent [19]

Kamatani et al.

[11] Patent Number: 5,768,746

[45] Date of Patent: Jun. 23, 1998

[54] ELECTRIC VACUUM CLEANER

[75] Inventors: Kazumasa Kamatani; Sadao Fukushima; Kazuyoshi Yoshimi, all of Hyogo-ken; Shuzo Ueyama, Kasai; Tomonari Kawaguchi, Ohtsu; Isao Yoneda, Himeji; Kazuhiro Fujii, Hyogo-ken, all of Japan

[73] Assignee: Sanyo Electric Co., Ltd., Moriguchi, Japan

[21] Appl. No.: 878,549

[22] Filed: Jun. 19, 1997

Related U.S. Application Data

[63] Continuation of Ser. No. 536,268, Sep. 29, 1995, abandoned.

[30] Foreign Application Priority Data

Oct. 28, 1994 [JP] Japan ..... 6-265857

[51] Int. Cl.[6] ..... A47L 9/00

[52] U.S. Cl. ..... 15/390; 15/391

[58] Field of Search ..... 15/389, 390, 391

[56] References Cited

U.S. PATENT DOCUMENTS 4,446,594 5/1984 Watanabe et al. .
4,446,595 5/1984 Nakada et al. .
4,637,092 1/1987 Hayashi et al. .
4,686,736 8/1987 Petralia ..... 15/390 X
4,748,714 6/1988 Tschudy .
5,331,716 7/1994 Hemmann et al. ..... 15/390 X

*Primary Examiner*—Chris K. Moore
*Attorney, Agent, or Firm*—Armstrong, Westerman, Hattori, McLeland & Naughton

[57] ABSTRACT

An electric vacuum cleaner comprising a floor nozzle connected to a lower part of a main body of the electric vacuum cleaner and having a suction opening opened on a lower surface of the floor nozzle, a rotary brush disposed in the suction opening, a driving source, a power transmission system which transmits power from the driving source to the rotary brush, and a changeover unit which connects or disconnects power transmission of the power transmission system, wherein the changeover unit is provided with an operation pedal, which is manipulated to connect or disconnect the power, on a rear portion of the floor nozzle. It is possible for an operator to instantaneously turn on and off the driving of the rotary brush only by stepping down or lifting up the pedal while gripping the handle at rear side of the main body of the cleaner without stopping the movement of the cleaner.

5 Claims, 16 Drawing Sheets

ELECTRIC VACUUM CLEANER

This application is a continuation of application Ser. No. 08/536,268 filed Sep. 29, 1995 now abandoned.

BACKGROUND OF THE INVENTION

The present invention relates to an electric vacuum cleaner and, more particularly, to an electric vacuum cleaner capable of easily turning a rotation brush on and off without interrupting the movement of the electric vacuum cleaner.

In a so-called upright type electric vacuum cleaner, a floor nozzle, which is moved along a floor surface, is rotatably connected, around a horizontal axis, to the lower part of the main body of the electric vacuum cleaner incorporating a blower and a dust collector therein. A suction opening is provided on the lower surface of the floor nozzle.

A rod-shaped handle is inserted into the upper part of the main body of the electric vacuum cleaner and is pushed and pulled to manually move the cleaner manipulation of such handle is detected to control the traveling unit, incorporated in the floor nozzle, for moving the cleaner.

A rotary brush is provided inside the suction opening. By rotating this rotary brush with a driving source, such as a motor for suction, dusts adhering on a carpet are adjustable for suction.

In such type of electric vacuum cleaner, though it is possible to effectively clean the carpet by rotating the rotary brush when the floor surface to be cleaned is covered with a carpet, the carpet can be damaged when the rotary brush is rotated while the electric vacuum cleaner is stopped and remains in the same place on carpet. Further, the floor surface might be damaged when the rotary brush is rotated on a wooden floor or "tatami" floor.

Therefore, in such type of electric vacuum cleaner, as shown in, for example, Japanese Unexamined Patent Publications No. 13727/1981 and No. 32720/1983, there has been proposed an electric vacuum cleaner which includes a power transmission system intermittently arbitrarily transmitting power from a power source to the rotary brush and an operation unit which operates the intermittent switching of power transmission for the power transmission system, and is designed to turn the driving of the rotary brush on and off by manually manipulating an operation tool provided on the operation unit as required.

In terms of the difference of the disconnecting mechanism, which intermittently transmits the power from the power source to the rotary brush arbitrarily, the power transmission system is roughly classified into a type in which it is possible to freely engage a transmission belt on a driven pulley, fixed to the rotary brush, and on a free pulley coaxially arranged with the driven pulley and freely rotatable against the rotary brush (hereinafter called as belt changeover type); and a type in which two wheels are arranged in a straight line, facing each other, and are contacted and separated (hereinafter called as clutch type).

Although the configuration of the operation unit that operates such disconnection mechanisms varies in accordance with the configuration of the disconnection mechanism, an operation tool to manually perform the changeover action is provided to the disconnection mechanism.

Conventionally, the operation tool is exposed on the front upper surface of the floor nozzle, as shown in, for example, Japanese Unexamined Patent Publication No. 13727/1981, to change over the disconnection mechanism by rotating or sliding the operation tool right and left.

When, for example, in a room where a part of a wooden floor is covered with a carpet, it is necessary to turn the driving of the rotary brush on and off by manipulating the operation tool at a border between a part where wooden board is exposed and a part where the carpet is placed, so as to stop the driving of the rotary brush where the board is exposed while driving the rotary brush where the carpet is placed.

However, in the conventional electric vacuum cleaner, a user, who is grasping the handle, has to bend down so that the user's one hand reaches the position near the floor in front of the main body of the electric vacuum cleaner because, as described above the operation tool is exposed on the front upper part of the floor nozzle.

Therefore, it is difficult to manipulate the operation tool, while moving the electric vacuum cleaner, and it is necessary to stop the moving of the cleaner to turn on and off the driving of the rotary brush each time when the cleaner approaches the border between the carpet and the wooden floor. Such operation is troublesome and it is impossible to easily turn on and off the driving of the rotary brush easily.

The present invention is made in view of the above circumstances, and therefore it is an object of the present invention to provide an electric vacuum cleaner capable of easily turning on and off the driving of the rotary brush without interrupting the movement of the cleaner.

SUMMARY OF THE INVENTION

In accordance with the present invention, there is provided an electric vacuum cleaner comprising a floor nozzle connected to a lower part of a main body of the electric vacuum cleaner and having a suction opening opened on a lower surface of the floor nozzle; a rotary brush disposed in the suction opening; a driving source; a power transmission system which transmits power from the driving source to the rotary brush; and a changeover unit which connects and disconnects power transmission of the power transmission system, wherein the changeover unit is provided with an operation pedal, which is manipulated to connect or disconnect the power, on a rear portion of the floor nozzle.

It is desirable that the changeover unit comprises a long slide lever having a working pin inserted into a rear end portion of the slide lever and a U-shaped belt guide formed on one side of a front end portion of the slide lever; and a guide means for guiding movement of the slide lever and a restricting means for restricting movement of the slide lever, both means being provided on the other side of the front end portion of the slide lever.

Moreover, it is desirable that the guide means comprises an L-shaped follower extending from the slide lever, and a guide groove formed on a fixed section of the main body to guide the follower.

Furthermore, it is desirable that the restricting means comprises a rectangular restricting member extending from the slide lever and an engaging member formed on the fixed section of the main body to engage with the restricting member.

It is possible for an operator, who is on the rear side of the main body of the cleaner with gripping a handle, to easily changeover the power transmission system by stepping down or kicking up the operation pedal while moving the electric vacuum cleaner.

DETAILED DESCRIPTION

The upright type electric vacuum cleaner according to an embodiment of the present invention is described below with reference to the accompanying drawings.

Figure 1:
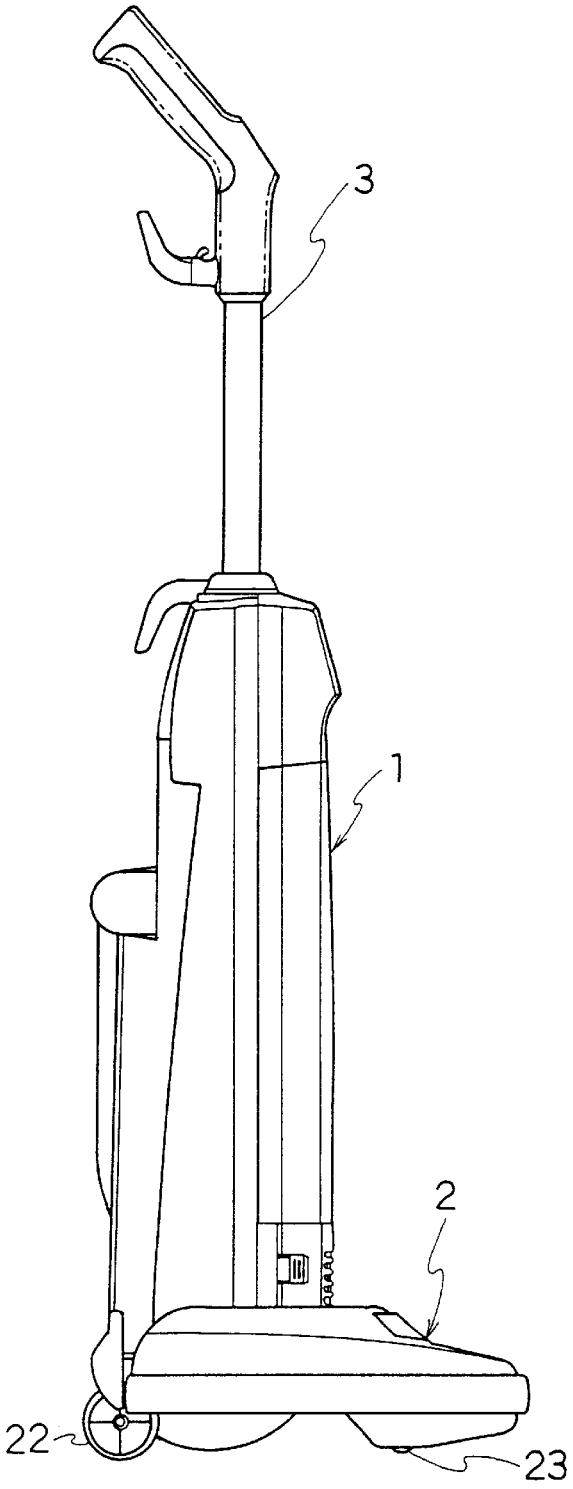
FIG. 1 is a side view of an embodiment of the present invention.

The upright type electric vacuum cleaner according to an embodiment of the present invention is, as shown in FIG. 1, provided with a main body 1, a floor nozzle 2 rotatably connected around the horizontal axis, vertical to the page surface, to the lower part of the main body 1, and a handle 3 inserted into the upper part of the main body 1. A suction motor and dust-collection bag are incorporated in the main body 1.

Figure 2:
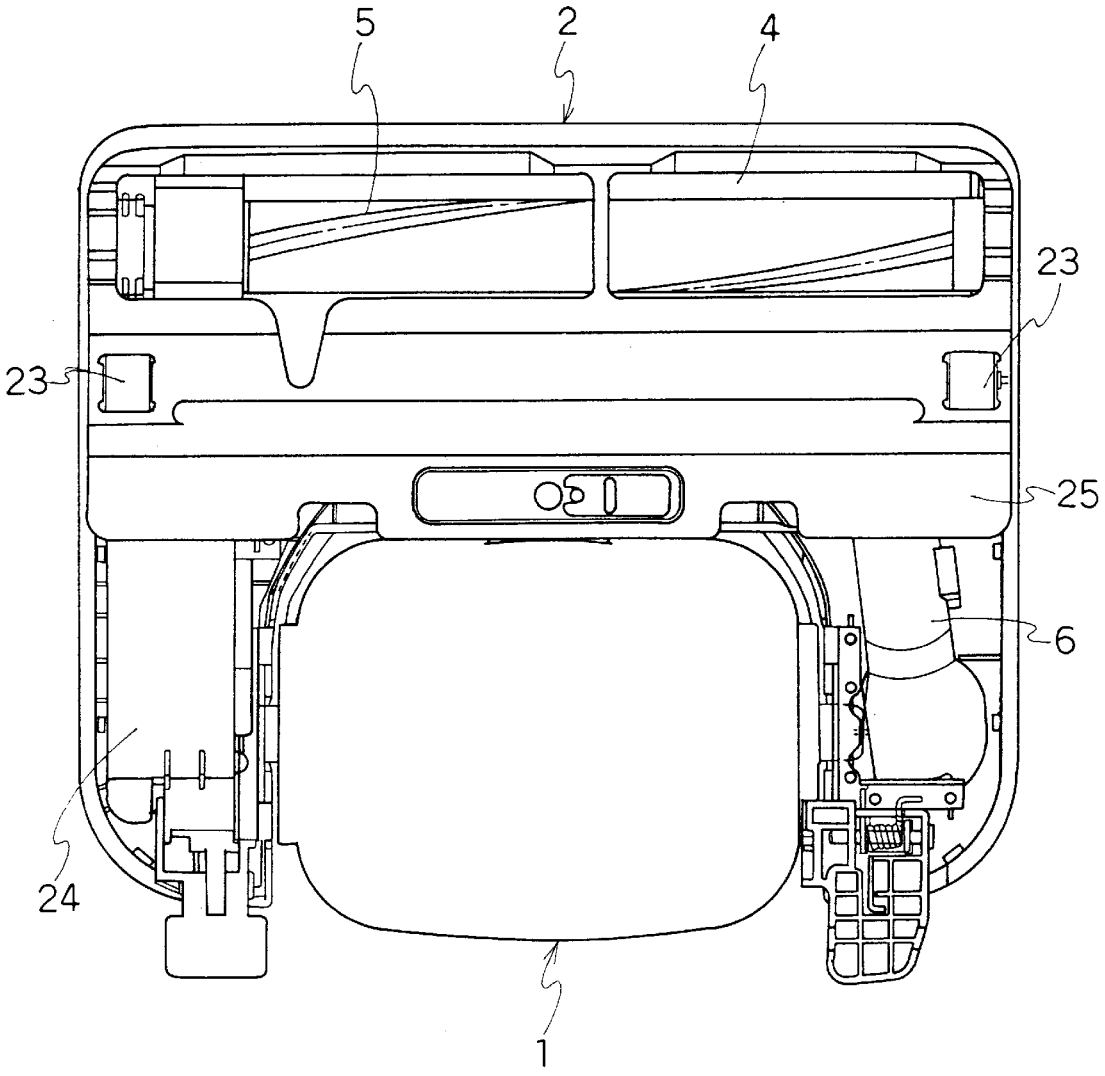
FIG. 2 is a bottom view of an embodiment of the present invention.

As shown in the bottom view in FIG. 2, the floor nozzle 2 is formed in a shape of a groove surrounding the front and both sides of the main body 1, and the inside of the front section is provided with a suction opening 4 opened on the lower surface and a rotary brush 5 that rotates within the suction opening 4.

Figure 3:
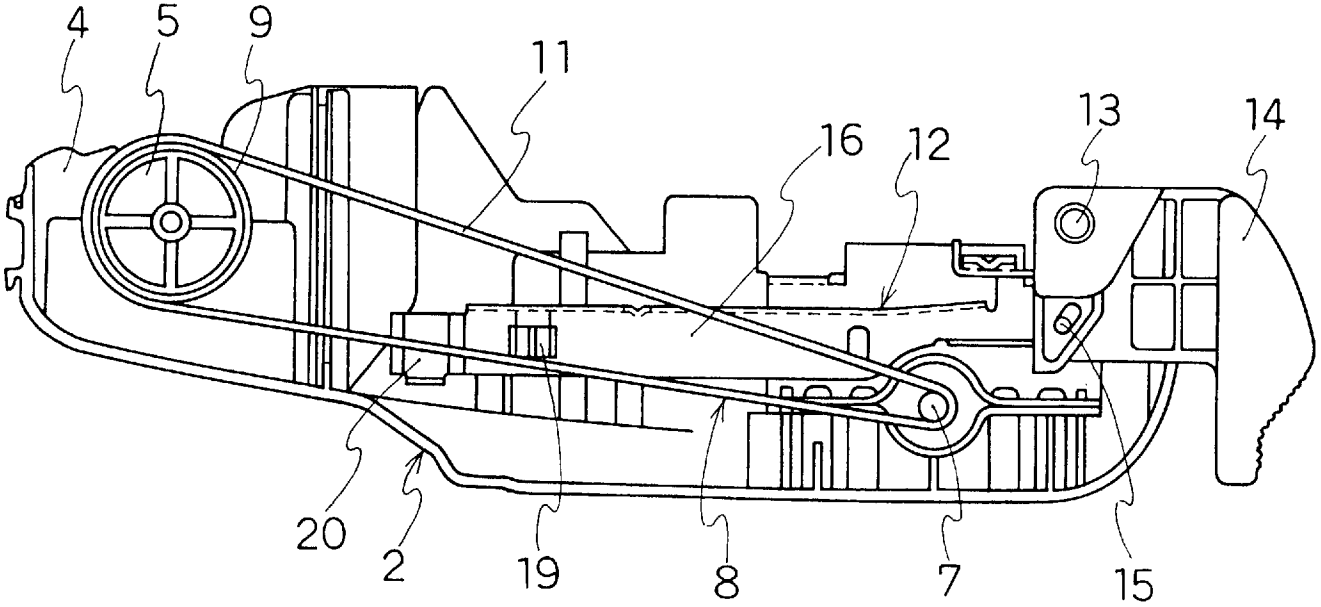
FIG. 3 is a side view of a power transmission system in an embodiment of the present invention when the rotary brush is being driven.
Figure 4:
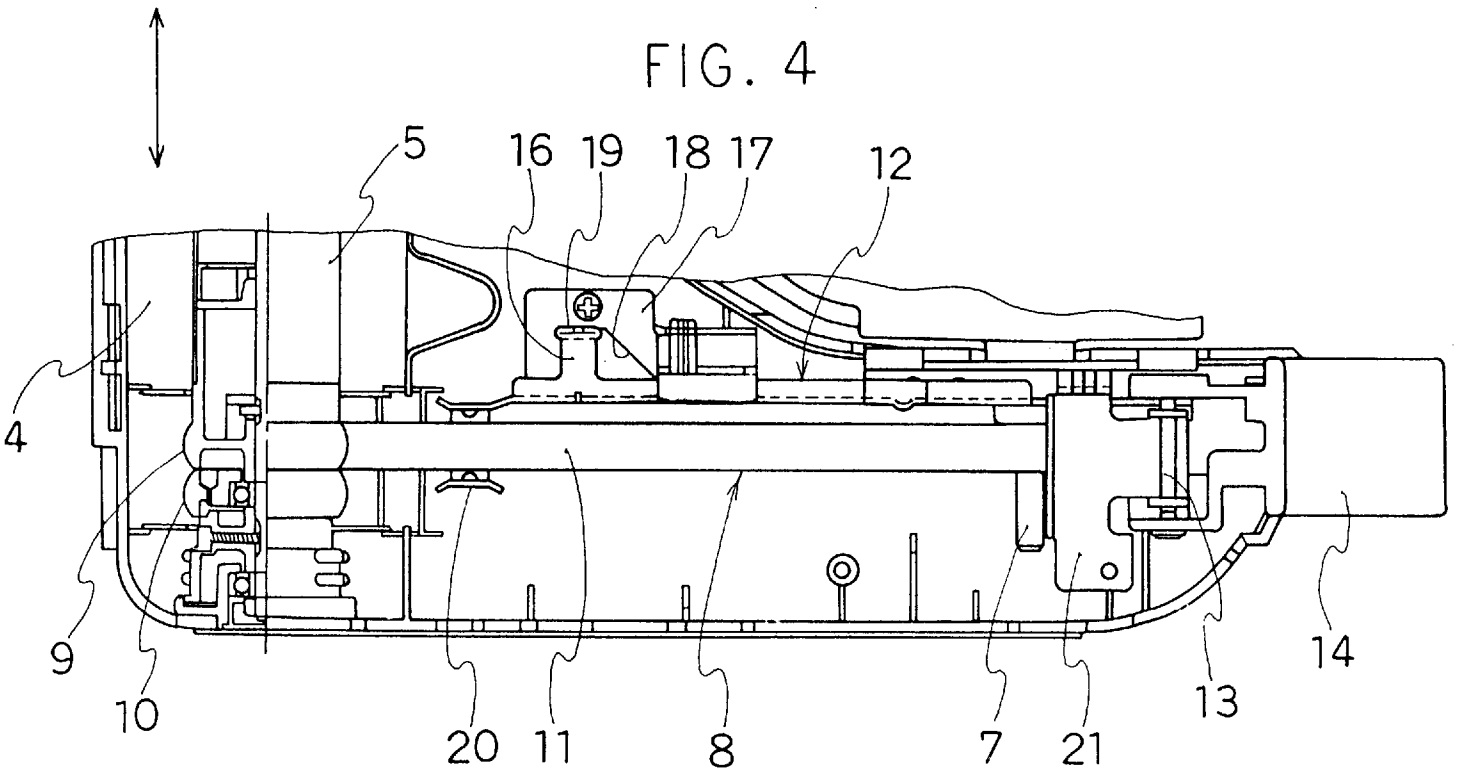
FIG. 4 is a bottom view of the power transmission system in an embodiment of the present invention when the rotary brush is being driven.

Furthermore, in FIG. 2, a duct 6, extending from the suction opening 4 to the left rear upper surface of the floor nozzle 2, is arranged within the left side section of the floor nozzle 2 shown on the right side of the main body 1, an FIG. 2, and a power transmission system 8, FIGS. 3 and 4, that arbitrarily and intermittently transmits the power from the rotation shaft 7 of the suction motor to the rotary brush 5 arranged within the right side section of the floor nozzle 2 as shown in FIGS. 3 to 6.

Figure 5:
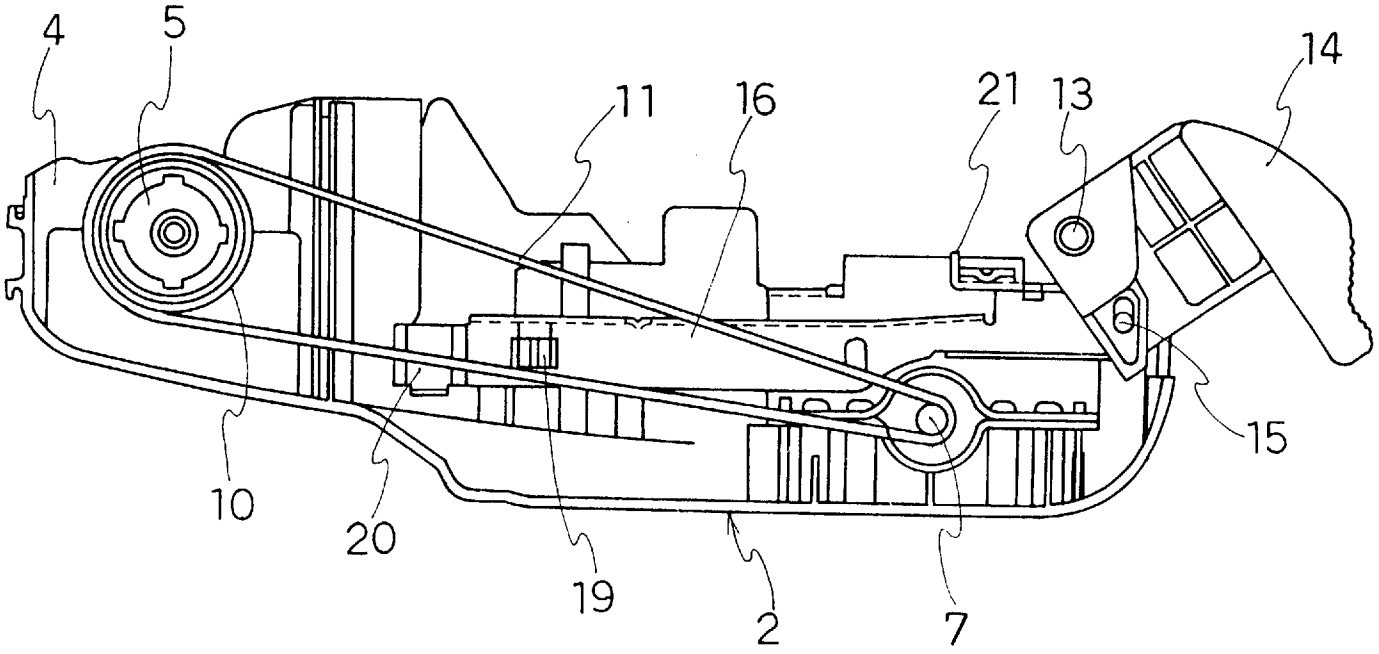
FIG. 5 is a side view of the power transmission 35 system in an embodiment of the present invention when the rotary brush is stopped.
Figure 6:
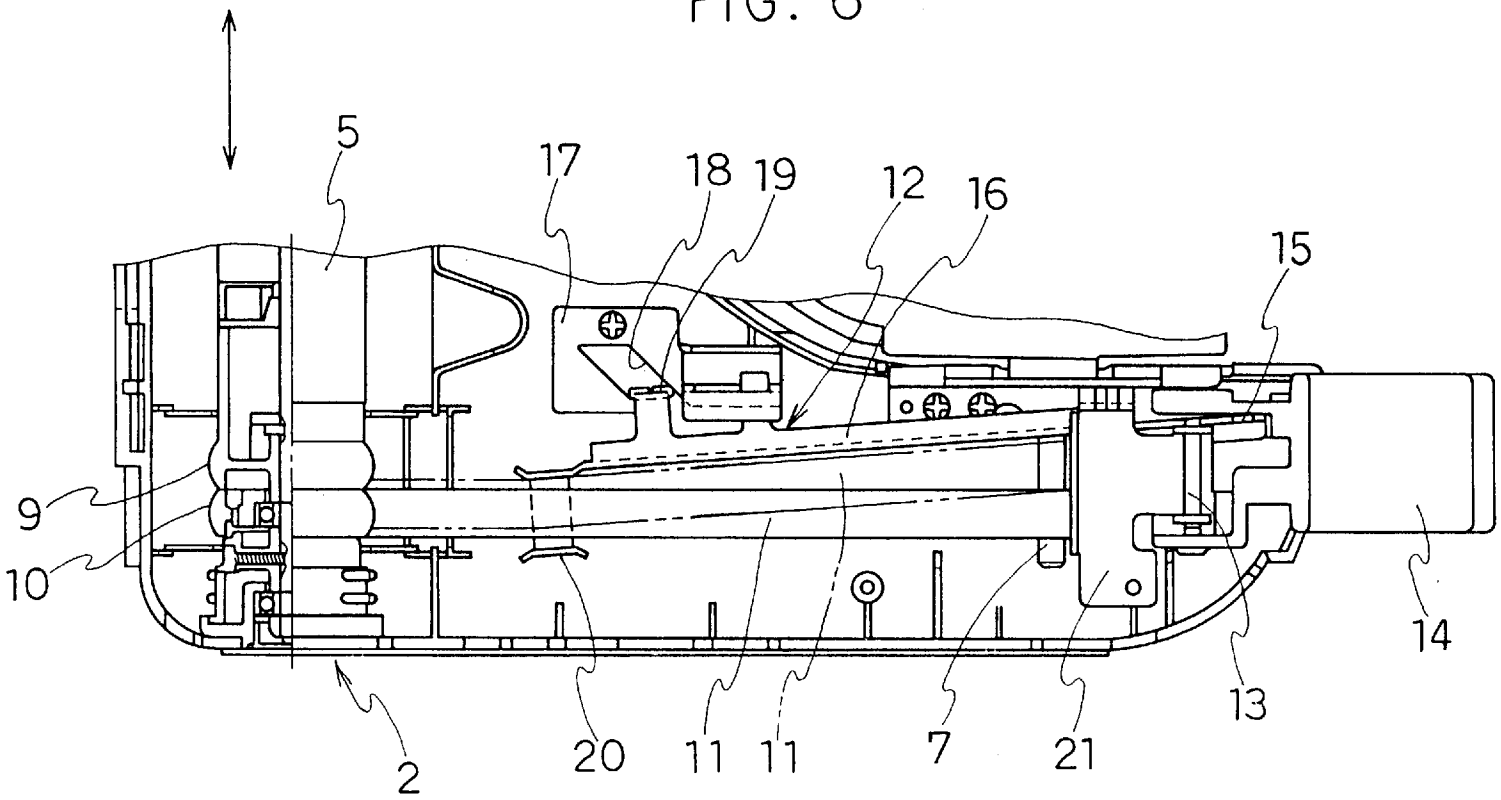
FIG. 6 is a bottom view of the power transmission system in an embodiment of the present invention when the rotary brush is stopped.

As shown in FIGS. 3 to 6, the power transmission system 8 is a belt changeover type and comprises a driven pulley 9, arranged coaxial with and fixed to the rotary brush 5, a free pulley 10, FIGS. 4, 5 and 6, arranged coaxial with the rotary brush 5 on the right side of the driven pulley 9 and capable of freely rotating against the rotary brush 5, and a transmission belt 11 which is wound around the rotation shaft 7 of the suction motor on one side and which is interchangeably engaged on the driven pulley 9 and the free pulley 10 on the other side.

A disconnection unit, FIGS. 4 and 6, is provided to allow the operator to arbitrarily changeover the transmission belt 11 of the power transmission system 8. The disconnection unit comprises a long slide lever 16, FIGS. 4–8 having a working pin 15 inserted into a rear end portion of the slide lever 16 and a U-shaped belt guide 20 formed on one side of a front end portion of the slide lever 16; and a guide means for guiding movement of the slide lever 16 and a restricting means for restricting movement of the slide lever 16, both means being provided on the other side of the front end portion of the slide lever 16. The disconnection unit 12, FIG. 6 is provided with a manipulation pedal 14 which is rotatably supported by a support pin 13 on the right rear section of the floor nozzle 2 to rotate around a right and left direction axis and extends rearward of the right side section of the floor nozzle 2.

A rear end section of the slide lever 16, provided within the right side section of the floor nozzle 2 to move in the front and rear directions, is connected to the manipulation pedal 14 via a working pin 15, FIG. 6, so that the slide lever 16 moves rearward with the pedal 14 stepped down and moves frontward with the pedal 14 lifted.

Figure 7:
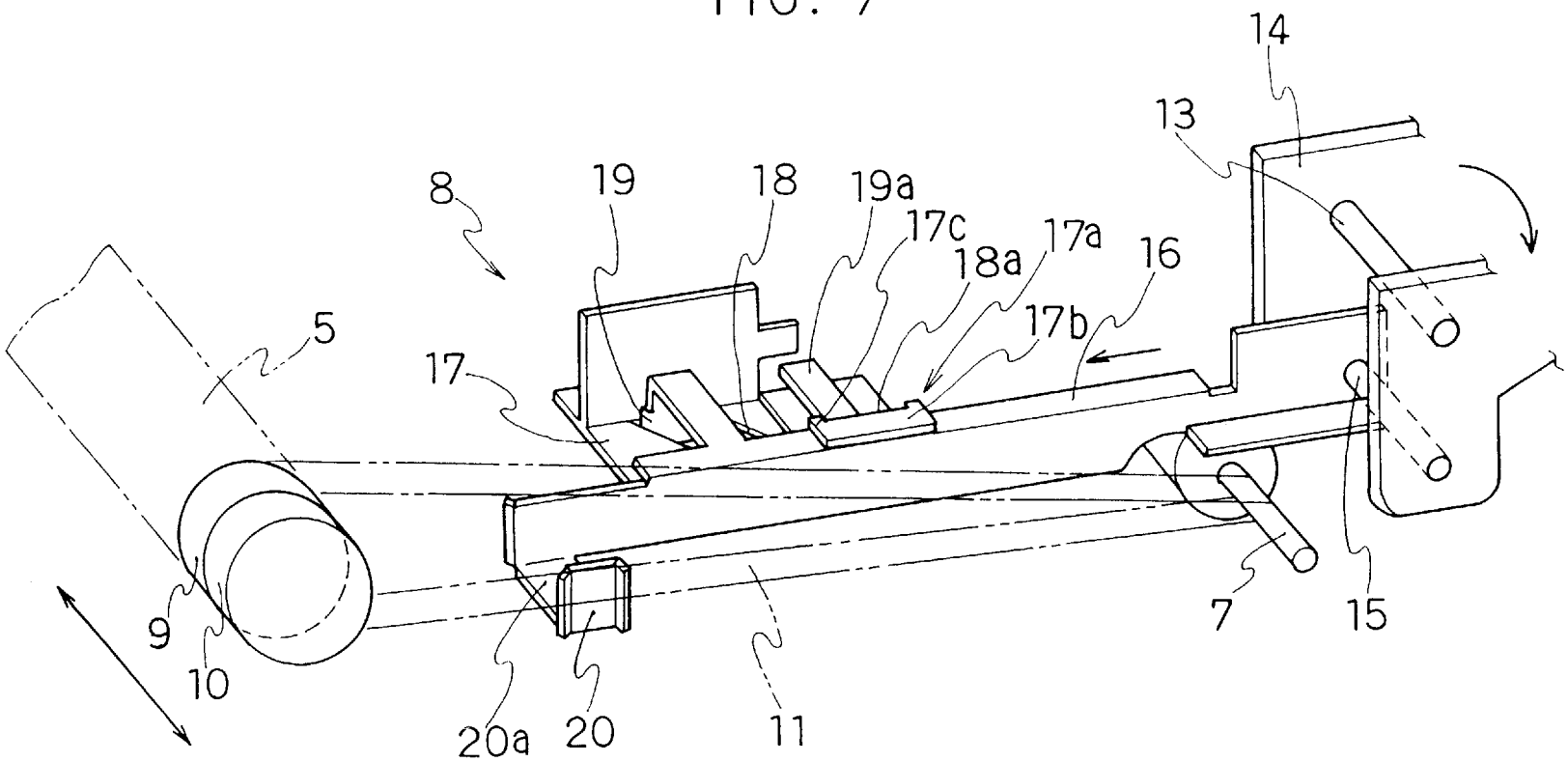
FIG. 7 is a perspective view showing frontward movement of a slide lever in a changeover unit of an embodiment of the present invention.
Figure 8:
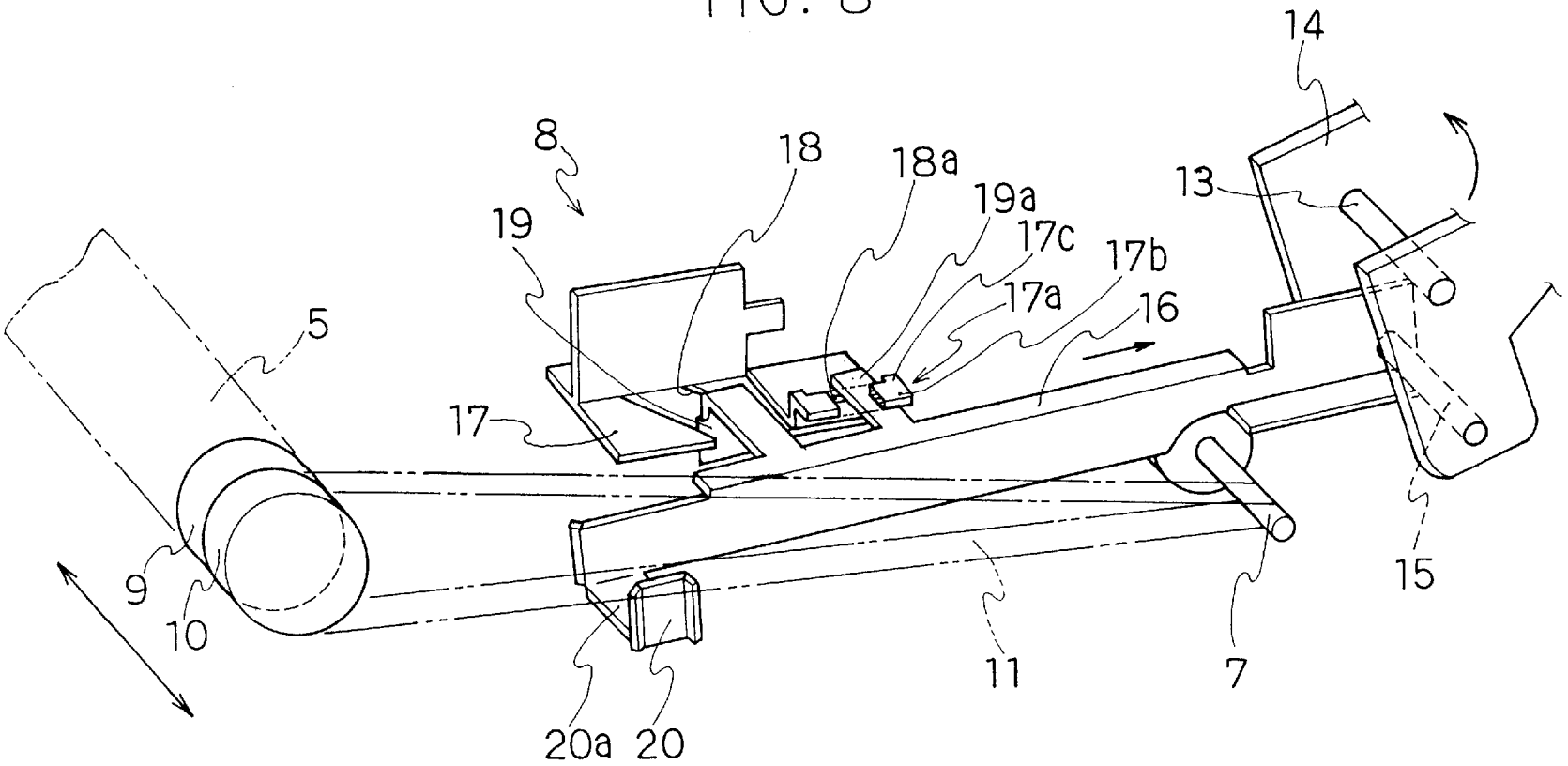
FIG. 8 is a perspective view showing rearward movement of a slide lever in a changeover unit of an embodiment of the present invention.

The guide means comprises an L-shaped follower 19, FIGS. 6–8 extending from the slide lever 16 and a guide groove 18 formed on the fixed section of the main body 1 to guide the follower 19. Namely, the front section of the slide lever 16 is provided with the follower 19 which slides within the guide groove 18 formed on the guide plate 17 fixed within the right side section of the floor nozzle 2. The guide groove 18 is slanted in the diagonally opposite direction from the right side corner of the guide plate 17. Therefore, the side lever 16 can smoothly and securely move by means of the follower 19 and the guide groove 18 as a guide means. Moreover, the restricting means comprises a rectangular restricting member 19*a,* FIGS. 7 and 8, extending from the side section of the slide lever 16 and an engaging member 17a formed on the fixing section of the main body 1 to engage with the restricting member 19a. The engaging member 17*a* has an approximately U-shaped form, and a restricting member 19a is inserted into an elongated hole 18a formed on the upper end of the engaging member 17*a*. Moreover, the engaging member 19*a* is restricted in downward direction- (direction towards the transmission belt 11) by means of the pressing section 17b on the upper end of the engaging member 17a so that the slide lever 16 is accurately positioned without dislocating at the time of operation, thereby preventing the bottom section 20*a* of the guide 20 a as described below, from contacting with the transmission belt 11. Moreover, the slide lever 16 is made of plate material and has higher strength so that the lever will not twist and be broken even if it is used for a long period of time. When the slide lever 16 is moved frontward, the follower 19 deeply enters the guide groove 18, and the front section of the slide lever 16 is deflected to left side direction until the restricting member 19*a* FIG. 7, is engaged with the front end section 17c of the engaging member 17a as shown in FIG. 4 and FIG. 7. When the side lever 16 is moved rearward, the follower 19 is pulled out near the entrance of the guide groove 18, and the front section of the slide lever 16 is deflected in right side direction until the restricting member 19a is engaged with the rear end section 17d of the engaging member 17a as shown in FIG. 6 and FIG. 8.

The front end section of the slide lever 16 is provided with a belt guide 20 to pinch the upper side rotation part of the transmission belt 11. When the belt guide 20 is deflected to the right side, the transmission belt 11 is wound around the free pulley 10. When the belt guide 20 is moved from the right side to the left side, the transmission belt 11 is accordingly moved from right side to the left side by belt guide 20 and changed over from the free pulley 10 to the driven pulley 9. Moreover, when the belt guide 20 is deflected to the left side, the transmission belt 11 is wound around the driven pulley 9. When the belt guide 20 is moved from the left to the right side, the transmission belt 11 is moved from the left side to the right side with being pushed by the belt guide 20 changed over from the driven pulley 9 to the free pulley 10.

Moreover, the circumferential surface of the driven pulley 9 and free pulley 10 is formed in a shape of a drum of the same size with its center part crowned so as to allow smooth changeover of engagement of the transmission belt 11 and prevent the disengagement of the engaged transmission belt 11. Moreover, the support pin 13 is fixed on the floor nozzle 2, via a pedal holder 21. Furthermore, as shown in FIG. 1, a rear wheel 22 is rotatably supported on the main body 1, and a front wheel 23 for transfer is rotatably supported on the lower part of the floor nozzle 2.

The electric vacuum cleaner is moved along on a floor surface by pushing and pulling, with the handle held by a hand and with the handle 3 and the main body 1 inclined in the rear direction. The pedal 14 projects from the rear right side section of the floor nozzle 2, so that it is possible for an operator to step down or lift up the pedal 14 at an arbitrary time while the operator moves the cleaner and grasping the handle 3.

As shown in FIGS. 5 and 6, when the pedal 14 is pushed down, the slide lever 16 retracted to change the transmission belt 11 from the driven pulley 9 to the free pulley 10, thereby turning off the driving of the rotary brush 5. On the other hand, as shown in FIG. 3 and FIG. 4, when the pedal 14 is lifted up, the slide lever 16 moves forward to change over the transmission belt 1 from the free pulley 10 to the driven pulley 9, thereby turning on the driving of rotary brush 5.

Thus, it is made possible to easily turn on and off the driving of the rotary brush 5 without stopping the transfer of the electric vacuum cleaner only by simple operation of stepping down and lifting up the pedal 14. For example, it is possible to continuously clean a floor by turning on and off the driving of the rotary brush 5 without stopping the cleaner when one moves from a floor covered with a carpet to a wooden floor or in an opposite direction.

Figure 9:
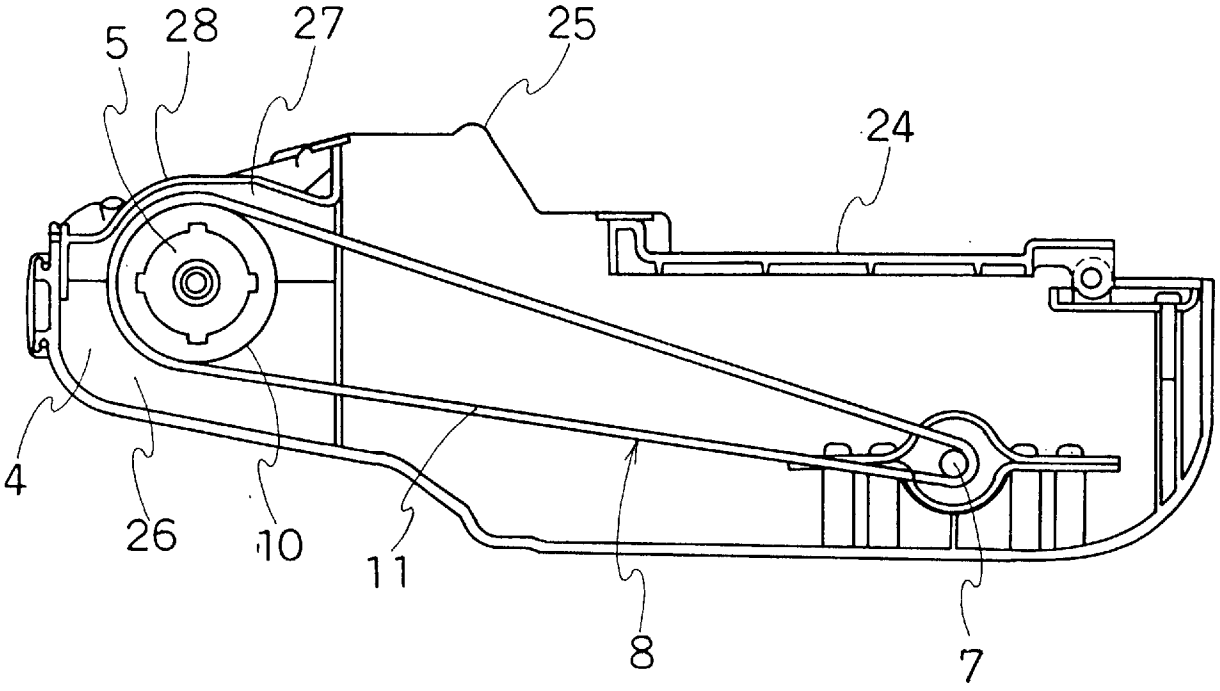
FIG. 9 is an explanatory sectional view of the floor nozzle in an embodiment of the present invention.
Figure 10:
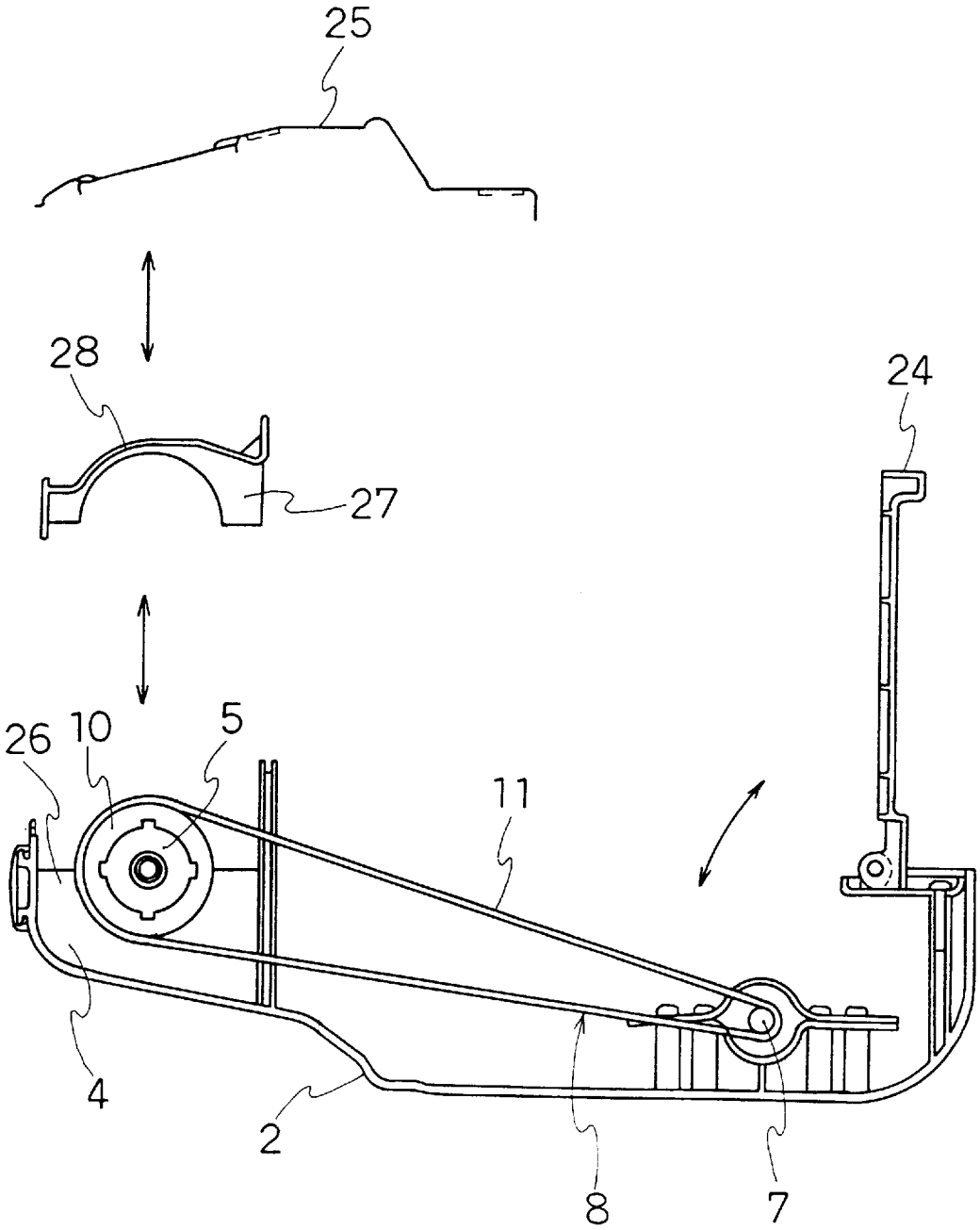
FIG. 10 is an explanatory sectional view of a disassembled floor nozzle in an embodiment of the present invention.
Figure 11:
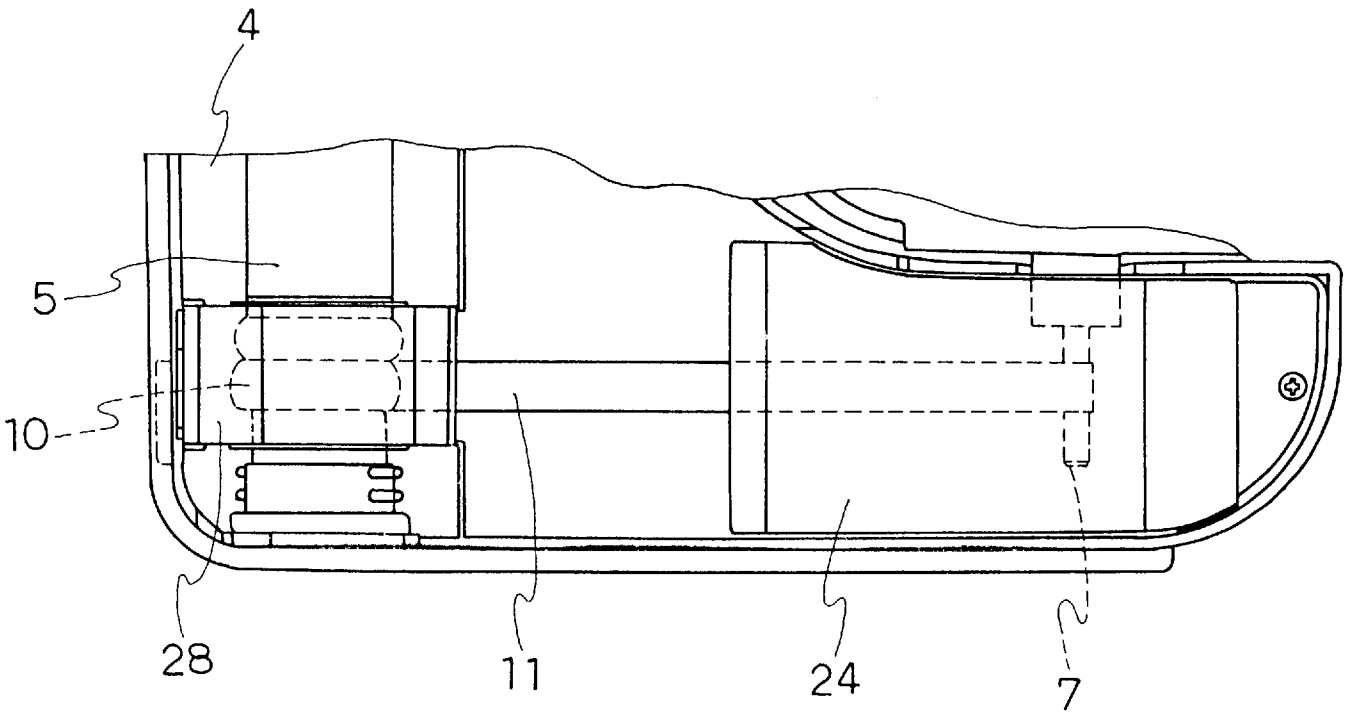
FIG. 11 is a bottom view of the floor nozzle without the bottom plate in an embodiment of the present invention.

Moreover, in the above embodiment, as shown in FIGS. 9 to 11, a belt cover 24, covering the rear part of the transmission system 8 from lower side, is rotatably supported on the lower right rear section of the floor nozzle 2 and a bottom plate 25 covering the floor nozzle 2 section positioned in front of the belt cover 24, from the lower side is attached so as to prevent a finger or hand from accessing to the power transmission system 8 or prevent dust from entering thereinto.

Figure 12:
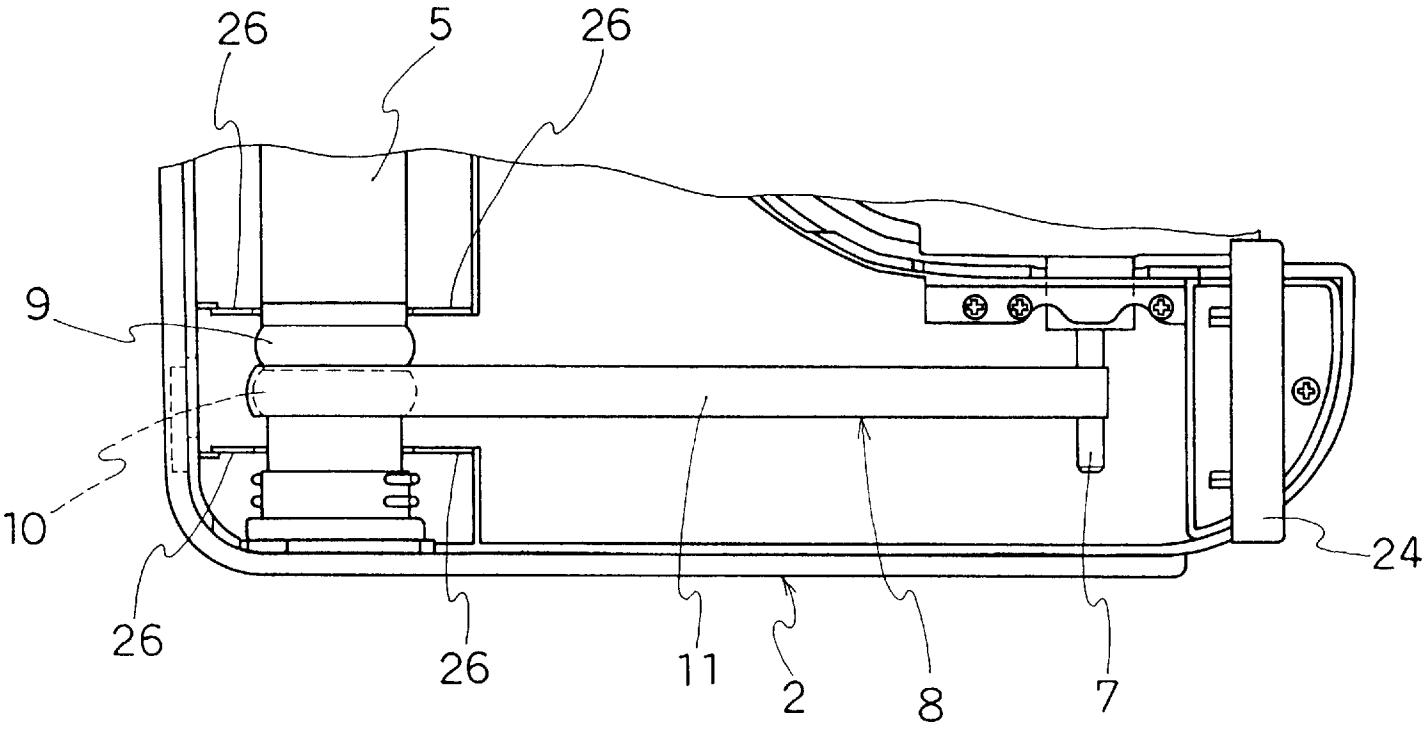
FIG. 12 is a bottom view of the disassembled floor nozzle in an embodiment of the present invention.

Moreover, in order to prevent the dust within the suction opening 4 from being trapped in the power transmission system 8, as shown in FIG. 9 and FIG. 12, the upper front right side within the floor nozzle 2 is provided with a dust-isolation wall 26 isolating the upper half section of the power transmission system 8 from the section opening 4. Further, as shown in FIGS. 9 to 11, a dust-isolation cover 28, having a dust-isolation wall 27 contacting with the dust-isolation wall 26 in the same plane, is detachably inserted into the lower right front section within the floor nozzle 2 from below.

The reason why the belt cover 24 is openably and closably provided and the dust-isolation cover 28 is detachably inserted is to make replacement of the transmission belt 11 possible. Replacing the transmission belt 11 will require three actions of detaching and attaching the bottom plate 25, opening and closing the belt cover 24, and pulling out and inserting the dust-isolation cover 28, which is troublesome. Furthermore, in order to insert the dust-isolation cover 28, it is necessary to match the position and direction of the dust-isolation cover 28 with the floor nozzle 2 so that it seems to be more troublesome. Moreover, there is a danger that the dust-isolation cover 28, hidden by the bottom plate 25, might be forgotten to be attached, so that the dust within the suction opening 4 intrudes the power transmission system 8 to abnormally promote the abrasion of the driven pulley 9, free pulley 10 and transmission belt 11.

Figure 13:
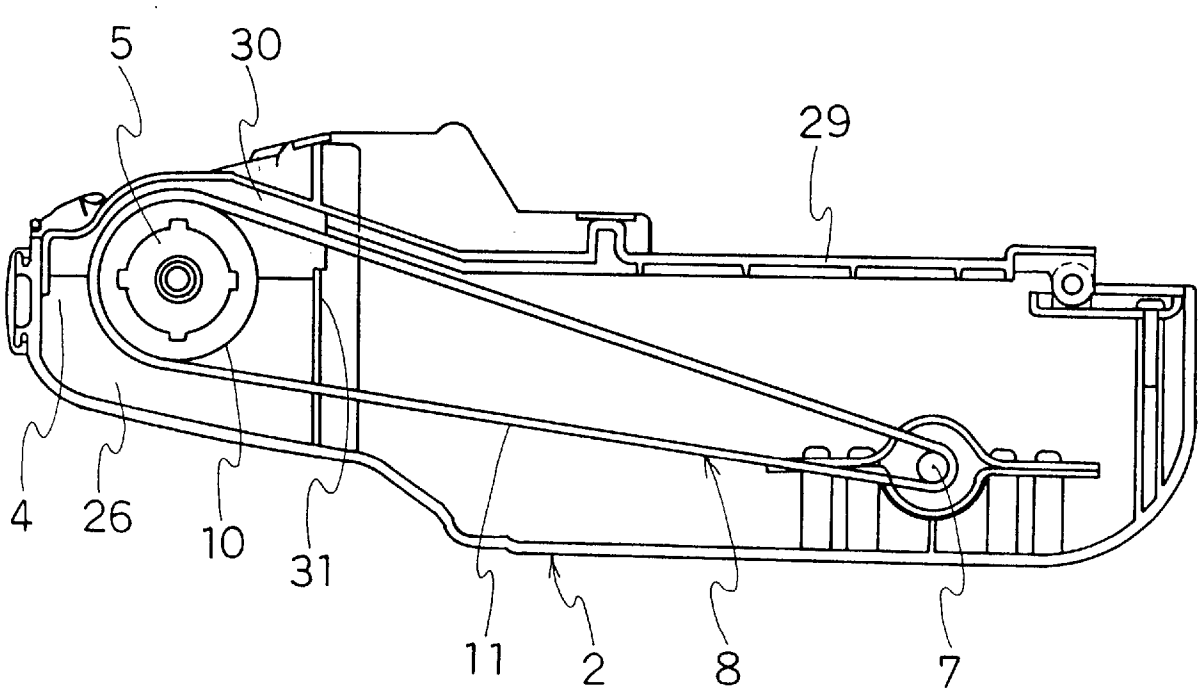
FIG. 13 is an explanatory sectional view of a floor nozzle in another embodiment of the present invention.
Figure 14:
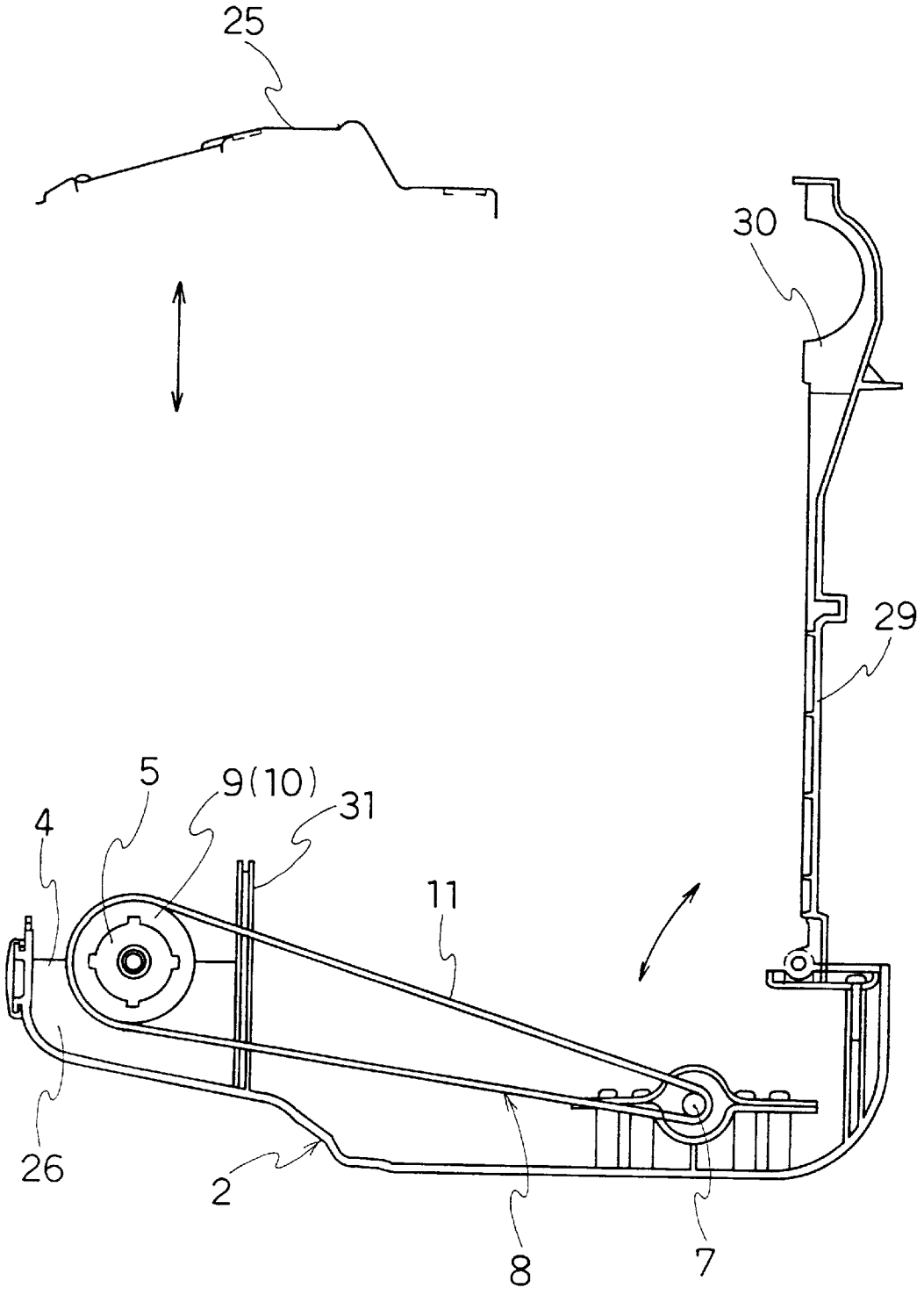
FIG. 14 is an explanatory sectional view of the disassembled floor nozzle in another embodiment of the present invention.

Therefore, in another embodiment of the present invention, as shown in FIG. 13 and FIG. 14, a one-body cover 29, covering the whole power transmission system 8 from below, is rotatably supported on the lower right rear side of the floor nozzle 2 and a dust-isolation wall 30, isolating the lower half section of the power transmission system 8, is connected to the front part of the one-body cover 29 to make it possible to replace the transmission belt 11 with two actions of detaching and attaching the bottom plate 25 and opening and closing the one-body cover 29.

Figure 15:
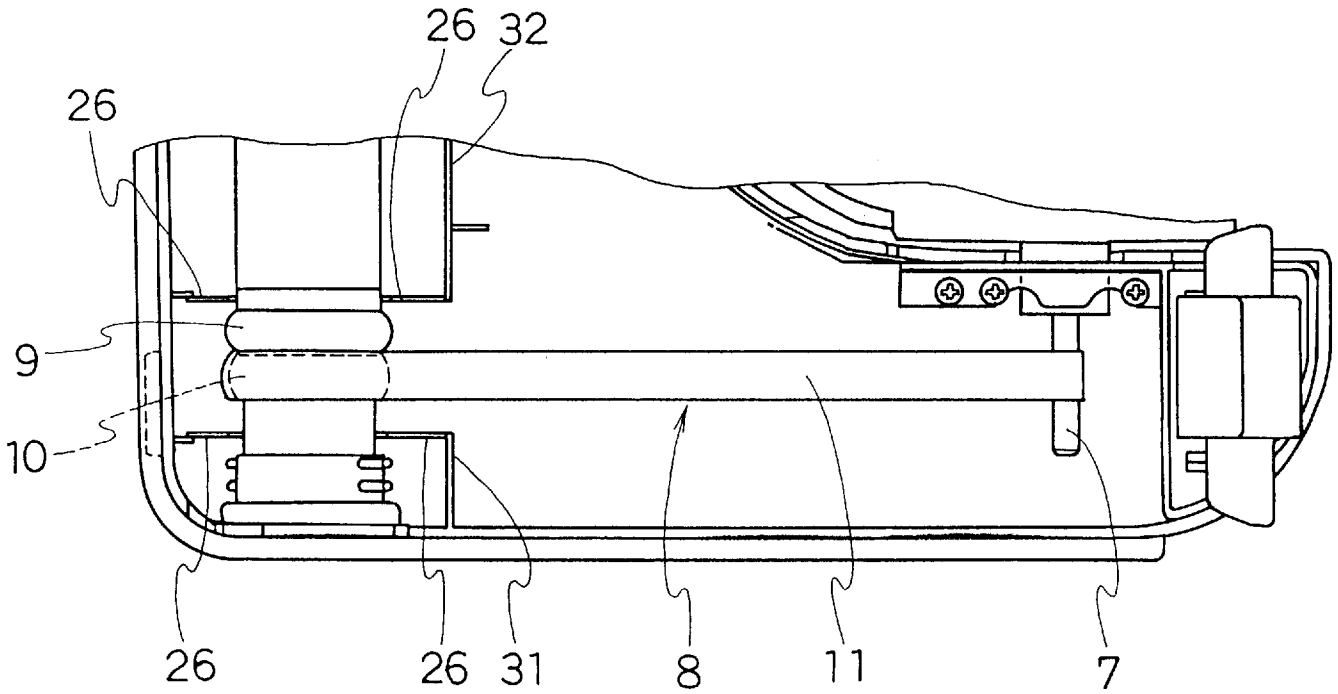
FIG. 15 is a bottom view of the disassembled floor nozzle in another embodiment of the present invention.
Figure 16:
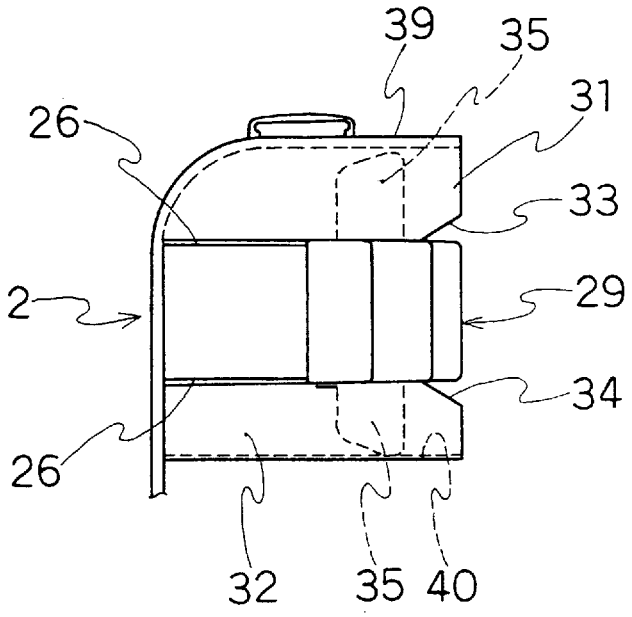
FIG. 16 is an explanatory sectional view of a main portion of the floor nozzle in an embodiment of the present invention.
Figure 17:
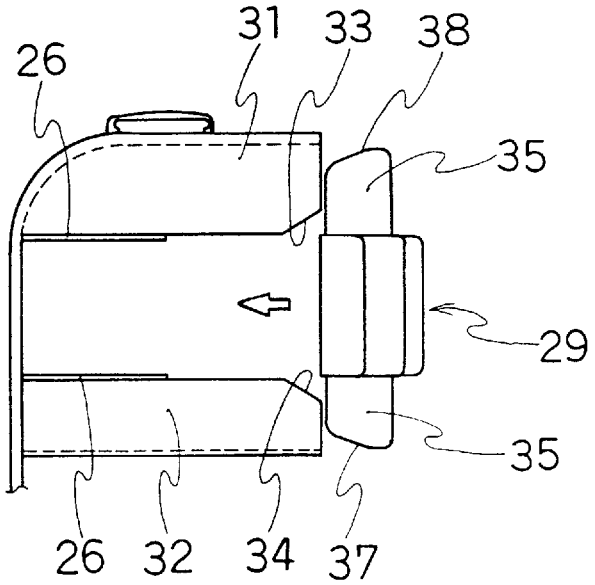
FIG. 17 is an explanatory sectional view of the main portion of the floor nozzle in an embodiment of the resent invention.

Moreover, as shown in FIGS. 13 to 15, a dust-isolation wall 26, isolating the upper half section of the power transmission system 8, is provided on the upper right front section within the floor nozzle 2. In order to close the dust-isolation wall 30 of the one-body cover 29 and the dust-isolation wall 26 within the floor nozzle 2 on the same plane, positioning ribs 31, 32 are provided on the front section within the floor nozzle 2 as shown in FIG. 15 and FIG. 17 so that the dust-isolation wall 30 for the one-body cover 29 is inserted between those ribs 31, 32 when the one-body cover 29 is closed.

In order to make it easier to insert the one-body cover 29 between the ribs 31, 32, slopes 33, 34, opening downward, are provided on the lower part of the ribs 31, 32 to prevent the dust-isolation wall 30 from being caught by the lower end section of the ribs 31, 32. On the other hand, chamfers 37, 38, closing upward and viewed from front side, are formed on the parts 35, 36 of the one-body cover 29 projecting right and left directions from between the ribs 31, 32 to prevent the one-body cover 29 from being caught by the side wall 39 of the floor nozzle 2 and the inside enforcement rib 40.

Moreover, the above-mentioned each embodiment is described with referring to a cleaner with a belt changeover type disconnection mechanism, however, the present invention is applicable to an electric vacuum cleaner with clutch type disconnection mechanism.

As described above, in the electric vacuum cleaner of the present invention, an operation pedal of the disconnection unit that changes over the power transmission of the power transmission system is provided on the rear right section or rear left section of the floor nozzle so that it is possible for an operator to easily turn on and off the driving of the rotary brush only by stepping down and lifted up, the pedal while gripping the handle at rear side of the main body of the cleaner without stopping the movement of the cleaner.

Moreover, it is possible to smoothly and accurately change over the power transmission by using a disconnection means comprising a long slide lever having a working pin inserted into a rear end portion of the slide lever and a U-shaped belt guide formed on one side of a front end portion of the slide lever; and a guide means for guiding movement of the slide lever and a restricting means for restricting movement of the slide lever, both means being provided on the other side of the front end portion of the slide lever.

Though several embodiments of the present invention are described above, it is to be understood that the present invention is not limited only to the abovementioned and various changes and modifications may be made in the invention without departing from the spirit and scope thereof.

What is claimed is:

1. An electric vacuum cleaner comprising a floor nozzle connected to a lower part of a main body of the vacuum cleaner and having a suction opening on a lower surface of a floor nozzle; a rotary brush disposed in the suction opening; a drive source; a power transmission system including a belt for transmitting power from the drive source to the rotary brush; and a changeover unit which selectively connects and disconnects power transmission of the power transmission system wherein the changeover unit includes an operating pedal which is manipulated to selectively connect and disconnect the transmitting belt and is provided on a rear portion of the floor nozzle; a long slide lever manipulated by the operating pedal and having a belt guide formed at a front end portion of the slide lever; and means on said slide lever for guiding and restricting movement of the slide lever.

2. An electric vacuum cleaner comprising a floor nozzle connected to a lower part of a main body of the electric vacuum cleaner and having a suction opening opened at a lower surface of the floor nozzle; a rotary brush disposed in the suction opening; a driving source; a power transmission system. including a belt for transmitting power from the driving source to the rotary brush; and a changeover unit which selectively connects and disconnects power transmission of the power transmission system; wherein the change over unit includes an operating pedal which is manipulated to selectively connect and disconnect the power and is provided on a rear portion of the floor nozzle; a long slide lever having a working pin engaging said operating pedal, said pin inserted into a rear end portion of the slide lever and a U-shaped belt guide formed on one side of a front end portion of the slide lever; and means on said slide lever for guiding and restricting movement of the slide lever and restricting movement of the slide lever.

3. The electric vacuum cleaner of any one of claim 1 or 2 wherein the guide means comprises an L-shaped follower extending from the slide lever and a guide groove formed on a fixed section of the main body for guiding [to guide] the follower.

4. The electric vacuum cleaner of any one of claim 1 or 2 wherein said restricting means comprises a rectangular restricted member extending from the slide lever and an engaging member formed on the fixed section of the main body for engagement with the restricting member.

5. The electric vacuum cleaner of claim 2, wherein the restricting means comprises a rectangular restricting member extending from the slide lever and an engaging member formed on the fixed section of the main body to engage with the restricting member.

* * * * *